United States Patent [19]

Tomita

[11] Patent Number: 4,589,368

[45] Date of Patent: May 20, 1986

[54] VARNISH COATER FOR PRINTED PRODUCT

[75] Inventor: Minoru Tomita, Ibaragi, Japan

[73] Assignee: Komori Printing Machinery Co., Ltd., Azumabashi, Japan

[21] Appl. No.: 655,943

[22] Filed: Sep. 28, 1984

[51] Int. Cl.[4] ..... B05C 11/10

[52] U.S. Cl. ..... 118/258; 137/577

[58] Field of Search ..... 118/258, 259, 429, 694, 118/262; 137/577

[56] References Cited

U.S. PATENT DOCUMENTS

| | | | |
|---|---|---|---|
| 1,321,513 | 11/1919 | Eaton | 137/577 |
| 1,740,979 | 12/1929 | Golrick | 118/DIG. 4 |
| 3,561,357 | 2/1971 | Schinke et al. | 101/148 |
| 3,605,682 | 9/1971 | Groce et al. | 118/694 |
| 4,022,125 | 5/1977 | Weaver | 101/148 |

*Primary Examiner*—John P. McIntosh

*Attorney, Agent, or Firm*—Blakely, Sokoloff, Taylor & Zafman

[57] ABSTRACT

A varnish coater for a printed product is provided, wherein a varnish supply pipe from a varnish tank is open at a position above a bucket-like varnish pan for storing varnish, overflow means connected between the varnish tank and a varnish drain pipe opens at a predetermined varnish level in the varnish pan, and varnish drain port means is formed in a bottom portion of the varnish pan so as to cause the varnish tank to communicate with the varnish drain pipe.

6 Claims, 5 Drawing Figures

VARNISH COATER FOR PRINTED PRODUCT

BACKGROUND OF THE INVENTION

The present invention relates to a varnish coater for a printed product, wherein the coater is arranged at the upstream side of a delivery unit of a rotary press or in an independent coating unit to apply varnish on a printed surface.

The surface of paper printed by a rotary printing press is not quickly dried and can be contaminated in the subsequent processing. In a sheet-fed rotary printing press, offsetting tends to be caused when printed sheets are attached. In order to solve these problems, conventionally, a dryer is arranged in a delivery path of the printed products, or a powder is sprayed on the printed paper surfaces. However, in this case, the dryer becomes large, and powder spraying results in surface roughening of the printed surface. Surface roughening tends to entail a loss of gloss and subsequent poor printing. Instead of these techniques, varnish is applied to the printed surface to prevent the surface from being contaminated and to give it gloss. Varnishing is performed in printed products such as covers of books, catalogs and pamphlets which require an aesthetic effect.

The varnish coater of this type is disposed between a printing unit and a delivery unit of a rotary press or in an independent coating unit. Furthermore, the varnish coater is used together with the dampening unit for the printing unit. The varnish coater generally has rollers in the same manner as that of a dampening apparatus for dampening a surface of a plate mounted on a plate cylinder of the printing unit. Varnish stored in a varnish pan is supplied to a surface of a blanket cylinder through the rollers. The varnish is transferred to a sheet passing between the blanket cylinder and an impression cylinder.

The varnish pan in the varnish coater has a bucket-like shape and is connected to an external varnish tank through piping. The temperature and concentration of varnish are adjusted to be uniform by a heater and stirring unit which are arranged in the varnish tank. The adjusted varnish is circulated by a pump. In order to perform uniform varnishing, the amount of varnish in the varnish pan must be kept constant. An overflow port is formed in the varnish pan to recover an excessive varnish portion to the varnish tank.

In the conventional varnish pan, the overflow port is formed at the upper portion of the varnish pan, and the pan roller is rotated. The upper layer of the varnish is stirred but the lower layer thereof will not be stirred. Therefore, the temperature of the lower layer of the varnish is decreased to increase the viscosity and concentration thereof. As a result, varnish having temperature and viscosity differences between the upper and lower layers is supplied to the varnishing portion, thus resulting in a nonuniform thickness of the varnish layer and hence degrading the product quality. In order to solve this problem, the varnish pan is periodically stirred. However, varnishing efficiency is degraded, and a great effect cannot be expected.

SUMMARY OF THE INVENTION

It is an object of the present invention to provide a varnish coater for a printed product, wherein a lower layer of varnish in a varnish pan can be stirred to stably supply varnish having a uniform viscosity or the like.

In order to achieve the above object of the present invention, there is provided a varnish coater for a printed product, wherein a varnish supply pipe from a varnish tank is open at a position above a bucket-like varnish pan for storing varnish, overflow means connected between the varnish tank and a varnish drain pipe is open at a predetermined varnish level in the varnish pan, and varnish drain port means is formed in a bottom portion of the varnish pan so as to cause the varnish tank to communicate with the varnish drain pipe.

BRIEF DESCRIPTION OF THE DRAWINGS

FIGS. 1 to 5 show a varnish coater according to an embodiment of the present invention, in which FIG. 1 is a side view showing the schematic configuration of a printing press to which the present invention is applied, FIG. 2 is a side view showing a fourth color printing unit and a coating unit, FIG. 3 is a sectional view of a varnish pan, and FIGS. 4 and 5 are respectively sectional views of a varnish pan, viewed from the same direction as in FIG. 1, according to other embodiments of the present invention.

DETAILED DESCRIPTION OF THE PREFERRED EMBODIMENT

Figure 1:
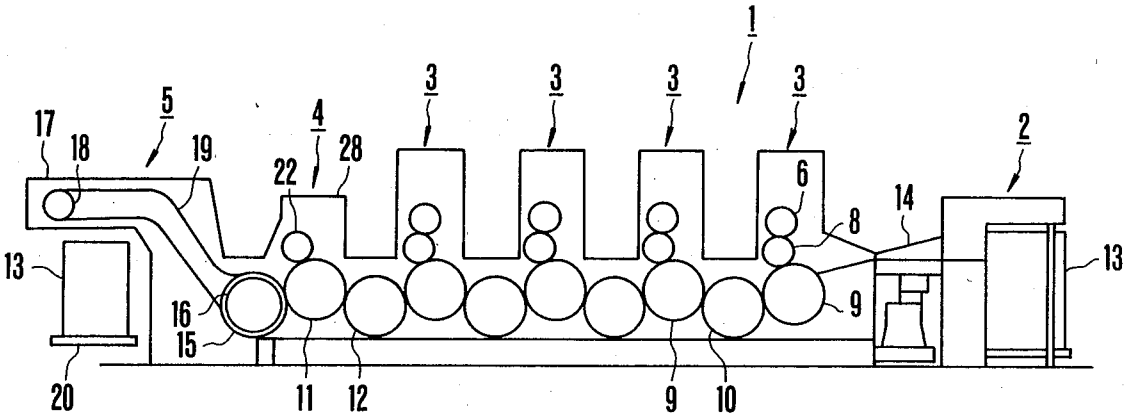
Figure 2:
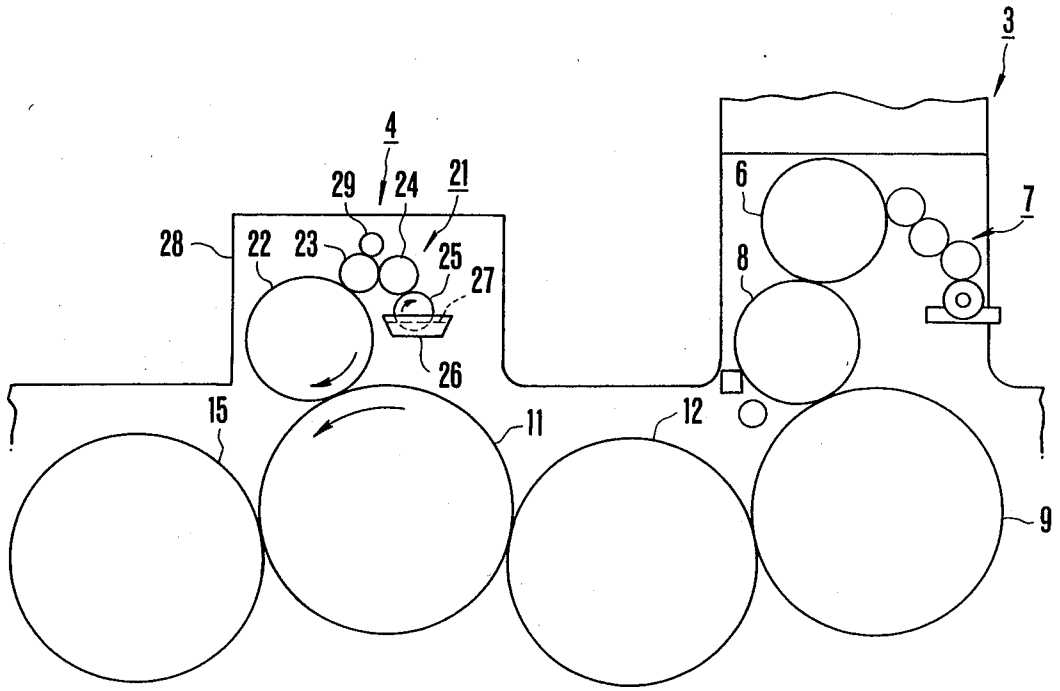
Figure 3:
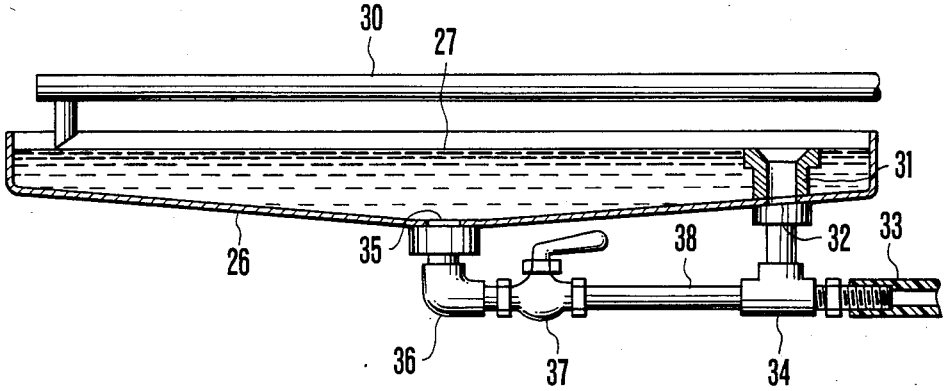

A preferred embodiment is exemplied when the present invention is applied to a four-color sheet-fed rotary printing press. FIG. 2 is a side view showing a fourth color printing unit and a coating unit, and FIG. 3 is a sectional view of a varnish pan. Referring to FIGS. 1 to 3, a printing press 1 comprises an automatic feeder 2, four color printing units 3, a coating unit 4, and a delivery unit 5. The respective units are separately manufactured and are assembled into an integral printing press. Each printing unit 3 comprises a plate cylinder 6 having a plate thereon, an inking unit (not shown) for supplying ink to the surface of the plate, and a dampening unit 7 for supplying dampening water to the surface of the plate. A blanket cylinder 8 is brought into rolling contact with the plate cylinder 6 so as to transfer an image formed on the plate surface with ink and dampening water. In each printing unit 3, an impression cylinder 9 having a diameter twice that of the blanket cylinder 8 is brought into rolling contact therewith. A transfer cylinder 10 having the same diameter as the impression cylinder 9 is sandwiched between adjacent impression cylinders 9 of the corresponding printing units 3. An impression cylinder 11 having a diameter twice that of a blanket cylinder 22 (having the same construction as the blanket cylinder 8) of the coating unit 4 is disposed to be in rolling contact with the blanket cylinder 22 and at the same level as the impression cylinders 9 of the printing units 3. A transfer cylinder 12 is sandwiched between the impression cylinder 9 of the fourth color printing unit 3 and the impression cylinder 11 of the coating unit 4. Paper sheets 13 stacked on the feed table of the automatic feeder 2 are taken up by a sheet pick-up device (not shown) and are fed one by one onto a feedboard 14. Each sheet 13 is gripped with grippers of the first color impression cylinder 9 by means of a swing gripper unit. The sheet 13 is printed by the blanket cylinders 8 with four colors while the sheet 13 is sequentially fed by the transfer cylinders 10 and the corresponding impression cylinders 9. The printed sheet is then gripped by grippers of the impression cylinder 11 and is wound therearound.

The delivery unit 5 comprises a delivery cylinder 15 which is brought into contact with the impression cylinder 11, and a pair of right and left sprockets 16 which are coaxially mounted on the delivery cylinder 15. Delivery chains 19 each having grippers at equal intervals are respectively looped between the right and left sprockets 16 and front end sprockets 18 of a delivery frame 17. The sheet 13 gripped by the grippers of the impression cylinder 11 is gripped by the grippers of the chains 19 and transferred thereby. The sheet 13 is released from the grippers of the chains onto a stack board 20.

The coating unit 4 having the construction described above has a varnish coater 21. A varnish coating roller unit in the coating unit 21 has the blanket cylinder 22 with a blanket thereon and in rolling contact with the impression cylinder 11, a form roller 23 brought into rolling contact with the blanket cylinder 22, a metering roller 24 brought into rolling contact with the form roller 23, and a pan roller 25 brought into rolling contact with the metering roller 24. The blanket cylinder 22 is mounted through an eccentric bearing and can be detached from the form roller 23 and the impression cylinder 11. The pan roller 25 is mounted extending across right and left frames 28 while the pan roller 25 is dipped in varnish 27 in the varnish pan 26. The two ends of the metering roller 24 are supported by a pair of arms rotatably mounted at the corresponding bearing portions at the two ends of the pan roller 25. The metering roller 24 is brought into tight rolling contact with the form roller 23 at a predetermined contact pressure given by a spring member and an adjustable stopper. The metering roller 24 is also brought into tight rolling contact with the pan roller 25 at a predetermined contact pressure eccentrically adjusted at the bearing portions. A rider roller 29 is supported by the arms to be brought into tight rolling contact with the form roller 23. The varnish 27 stored in the varnish pan 26 is drawn by the pan roller 25 which is rotated in the direction indicated by the arrow. A thickness of a layer of the varnish 27 is adjusted by the metering roller 24. The varnish 27 is then transferred to the form roller 23 and then the blanket cylinder 22 and is applied to the sheet 13 passing through the blanket cylinder 22 and the impression cylinder 11.

The varnish pan 26 will be described in detail. The varnish pan 26 has a bucket-like shape and substantially the same length as that of the blanket cylinder 22. The varnish pan 26 is supported at the side of the frame 28. The bottom surface of the varnish pan 26 is inclined downward toward the center thereof. A varnish supply pipe 30 connected to the varnish tank (not shown) is opened above one end of the longitudinal direction. When a pump arranged in the vicinity of the varnish tank is operated, the varnish 27 is supplied to the varnish pan 26. An overflow pipe 31 as an overflow means is fixed inside the varnish pan 26 at the end opposing the opening of the supply pipe 30. The upper opening end of the overflow pipe 30 is set at a level slightly lower than the top of the varnish pan 26 so as to overflow the varnish 27. A drain port 32 is formed in the bottom plate of the varnish pan 26 so as to correspond to the overflow pipe 31. A joint 34 is mounted at the drain port 32 to connect the varnish tank to a hose 33. Another drain port 35 is formed at the lowermost portion (central portion along the longitudinal direction of the varnish pan 26) of the bottom plate. A joint 36 coupled to the drain port 35 is connected to the joint 34 by a pipe 38 with an adjustrable cock 37.

In the varnish coater having the construction described above, the varnish 27 stored in the varnish tank is delivered by a pump and is supplied to an end portion of the varnish pan 26 through the varnish supply pipe 30. When the surface of the varnish 27 supplied to the varnish pan 26 exceeds the level corresponding to the upper opening end of the overflow pipe 31, the excessive portion of the varnish 27 is discharged from the drain port 32 and returns to the varnish tank through the joint 34 and the hose 33. When the cock 37 is opened, the varnish 27, even in the normal state, is partially discharged from the drain port 35 and returns to the varnish tank through the joint 36, the cock 37, the pipe 38, the joint 34 and the hose 33. The opening of the cock 37 is adjusted by checking the overflow state so as to prevent the varnish from being overflowed, so that the circulation of varnish can be performed through the drain port 35. The varnish 27 is moved from one end (of the varnish pan 26), where the varnish supply pipe 30 is opened, to the central portion thereof where the drain port 35 is opened, so that the lower layer of the varnish 27 in the vicinity of the bottom plate is stirred along with this varnish flow. The cock 37 is also used to allow cleaning of the varnish pan 26. After the varnish 27 is discharged from the varnish pan 26, a cleaning solution is supplied to the varnish pan 26. In this case, the cock 37 is fully opened, and every single droplet of the cleaning liquid can return to the cleaning solution tank.

Figure 4:
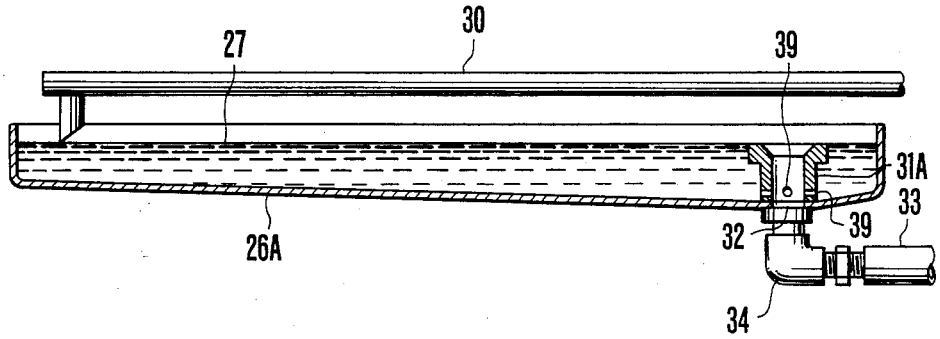

FIG. 4 is a sectional view of a varnish pan according to another embodiment of the present invention viewed from the same direction as in FIG. 3. According to this embodiment, a bottom plate of a varnish pan 26A is inclined from one end (corresponding to the opening of a varnish supply pipe 30) of the varnish pan 26A to the other end thereof. A drain port 32 is opened at the lowermost portion of the varnish pan 26A. A hose 33 is coupled to the drain port 32 through a joint 34. An overflow pipe 31A is coupled to the drain port 32. A plurality of small holes 39 which cause the varnish pan 26A to communicate with the interior of the overflow pipe 31A are formed at the lower portion of the overflow pipe 31A. The varnish 27 supplied from the varnish supply pipe 30 overflows from the overflow pipe 31A to the discharge port 32. At the same time, the varnish flows toward and through the small holes 39 and is discharged though the hose 33 via the overflow pipe 31A. Therefore, the lower layer of the varnish 27 is sufficiently stirred while it flows from one end to the other end of the varnish pan 26A. The overflow pipe 31A can be detachably mounted to discharge the varnish when the varnish pan 26A is cleaned.

Figure 5:
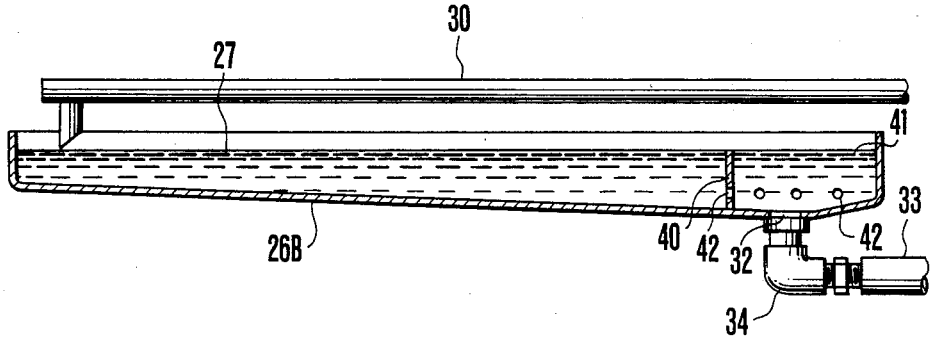

FIG. 5 is a sectional view of a varnish pan according to still another embodiment. This third embodiment is substantially the same as that of the first and second embodiments, except for a varnish pan and an overflow means. A small compartment 41 is formed by a partition plate 40 in a varnish pan 26B. A plurality of small holes 42 for causing the small compartment 41 to communicate with a remaining space in the varnish pan 26B are formed around the small compartment 41. The varnish 27 supplied from a varnish supply pipe 30 overflows and is discharged from the small compartment 41 through a drain port 32. At the same time, the varnish 27 flows in the small holes 42 formed at the lower portion of the varnish pan 26B and is discharged from the hose 33.

Therefore, the lower layer of the varnish 27 is sufficiently stirred while it flows from one end to the other end of the varnish pan 26B.

As has been apparent from the above description, in the varnish coater for a printed product according to the present invention, a varnish drain port coupled to the varnish tank through the varnish drain pipe is formed at the bottom portion of a varnish pan having a varnish supply port and an overflow port. An excessive portion of varnish is discharged from the overflow port and the varnish drain port. The upper and lower layers of varnish in the varnish pan are sufficiently stirred to prevent nonuniform viscosity and concentration throughout the varnish pan. A uniform varnish film can be coated on the surface of the printed product, thereby greatly improving quality of the printed products. In addition, when varnishing is completed, all the varnish can be automatically discharged from the varnish pan when varnish is stopped. Manual operation need not be substantially performed with respect to the varnish pan, thereby contributing to full automatic operation. The recovery of varnish, cleaning of the varnish pan by supplying a solvent, and discharge of the solvent can be automatically performed to provide a great operational advantage. When the varnish supply port is formed at one end of the varnish pan and the varnish drain port is formed at the other end thereof, stirring can be further facilitated. When a drain cock is provided, a ratio of an overflowed varnish amount to a total discharge varnish amount can be adjusted to maximize the effect of the present invention.

What is claimed is:

1. A varnish coater for coating a printed product comprising:

a bucket-like varnish pan for storing varnish;

a varnish supply pipe disposed above said varnish pan for supplying said varnish from a varnish tank;

a varnish drain port means provided in a bottom of said varnish pan to be coupled with a varnish drain pipe; and an overflow means surrounding said varnish drain port means so that when the level of said varnish exceeds a predetermined varnish level, said varnish overflow is led to said drain port means;

said overflow means including a hole for leading a portion of said varnish in the vicinity of said bottom portion of said varnish pan to said drain port means.

2. A varnish coater according to claim 1, wherein said varnish pan has a bottom plate which is inclined downward from one end to the other end thereof.

3. A varnish coated according to claim 2, wherein said overflow means comprises an overflow pipe with a plurality of small holes formed in a lower portion thereof, said overflow pipe being connected to a lowest portion of said bottom plate to which said drain port means is provided.

4. A varnish coater according to claim 3, wherein said varnish supply pipe has an opening at one end of said varnish pan and said overflow means is disposed at the other end of varnish pan.

5. A varnish coated according to claim 1, wherein said overflow means comprises a partition wall with a plurality of small holes formed in the lower portion thereof so as to define a small chamber, said chamber communicating with said drain pipe through said drain port means.

6. A varnish coated according to claim 5, wherein said varnish supply pipe has an opening at one end of said varnish pan, and said overflow means is disposed at the other end of said varnish pan.

* * * * *